United States Patent [19]

Amabili

[11] 4,055,266

[45] Oct. 25, 1977

[54] COMBINATION CROWN TWIST-OFF CLOSURE CAPP

[76] Inventor: Arnaldo Amabili, 7680 Dollier Street, St. Leonard, Quebec, Canada

[21] Appl. No.: 735,781

[22] Filed: Oct. 26, 1976

[51] Int. Cl.[2] ..... B65D 41/34

[52] U.S. Cl. ..... 215/252; 215/253; 215/328

[58] Field of Search ..... 215/252, 253, 328, 337, 215/324, 327

[56] References Cited

U.S. PATENT DOCUMENTS

| | | | |
|---|---|---|---|
| 3,280,999 | 10/1966 | Warmer | 215/328 |
| 3,410,435 | 11/1968 | Kopczynski | 215/328 X |
| 3,606,062 | 9/1971 | Frisch | 215/328 |
| 3,648,874 | 3/1972 | Moller | 215/252 |
| 3,812,991 | 5/1974 | Wurl | 215/252 |
| 3,861,551 | 1/1975 | Hannon | 215/252 |
| 3,910,443 | 10/1975 | Hadley | 215/252 |

*Primary Examiner*—Donald F. Norton
*Attorney, Agent, or Firm*—McFadden, Fincham & Co.

[57] ABSTRACT

The present invention provides a closure cap of the threaded crown type, which closure cap includes one or more flanges depending from a skirt of the closure cap, the flange being adapted to engage a locking shoulder on the container, the flange having at least one weakening line therein, such that the flange either ruptures or spreads on removal of the closure flaring outwardly due to a camming action of the locking shoulder.

10 Claims, 5 Drawing Figures

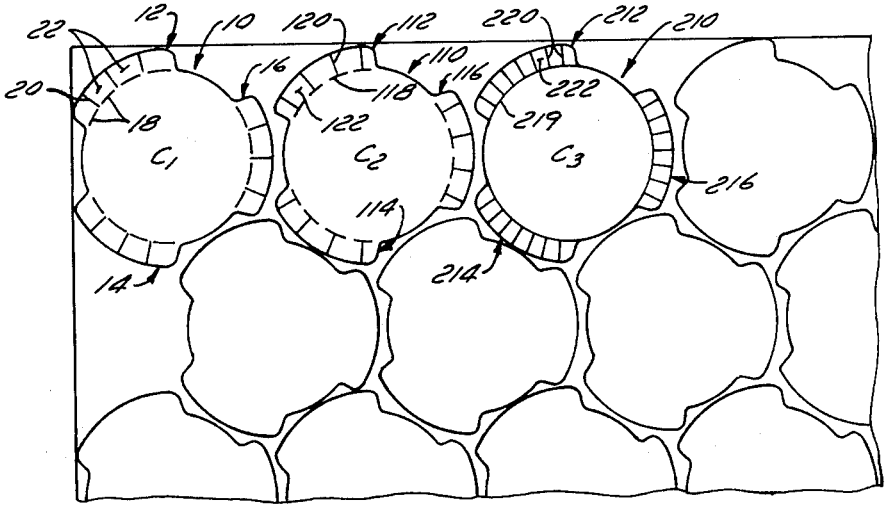
FIG. 1
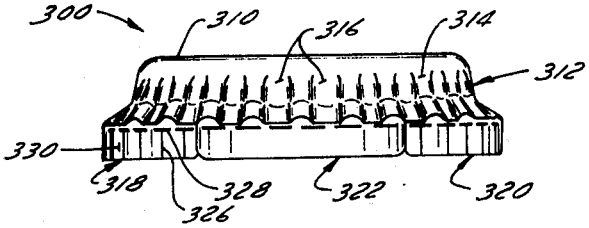
FIG. 2
FIG. 3
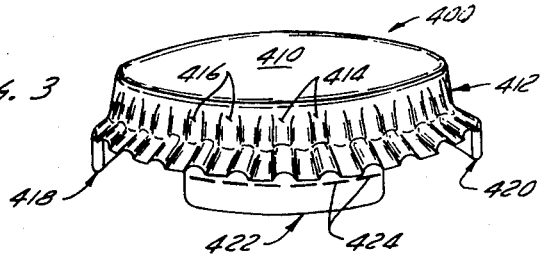

COMBINATION CROWN TWIST-OFF CLOSURE CAPP

The present invention relates to closure caps and more particularly, relates to closure caps of the threaded crown type.

The manufacture and use of threaded crown closures is well known in the art and reference may be had to, for example, U.S. Pat. No. 3,514,004 to Hammersmith which teaches a closure cap of the crown type which has a protected edge. Other patents relating to the crown type closure cap include U.S. Pat. Nos. 3,346,134; 3,410,435; 3,774,795 and 3,446,380.

Closure caps of the crown type, as aforementioned, have received wide commercial usage. One disadvantage of the ordinary crown closure cap is that a special opener must be employed for removing the cap from the container. To overcome this problem, it has been proposed, as exemplified by the above patents, to employ containers having an externally threaded neck with threaded crown closure caps such that they may be opened without the use of a special tool or device. Furthermore, such threaded closure caps enable one to re-seal the container if the contents are not completely used.

However, despite the above advantages, threaded crown closure caps have not received the wide acceptance one might expect. One problem inherent in such caps is that, since they are re-sealable, tampering with the container may occur — the cap can be removed and subsequently replaced on the bottle.

Generally, it is an object of the present invention to provide a closure cap of the crown type which may be removed by unscrewing the same or, alternatively, by means of a conventional cap remover.

It is a further object of the present invention to provide a pilfer-proof closure cap, which cap may be removed by unscrewing or by means of a conventional cap remover, the cap having means thereon to indicate when the cap has been removed from the container.

Generally, in one aspect of the present invention, there is provided a closure cap for use with a container having an externally threaded neck and locking shoulder, the closure cap comprising a top and a depending skirt having threads formed thereon for engagement with the threads of the container. The cap includes at least one flange depending from the skirt, the flange being adapted to engage the locking shoulder of the container.

In a further aspect of the invention, there is provided a closure cap for use with a container having an externally threaded neck and locking shoulder, the closure cap comprising a top and a peripheral skirt depending therefrom. The skirt is corrugated and has threads formed internally thereof for mating engagement with the threaded neck of the container. The cap further includes a plurality of spaced flanges integral with and depending from the skirt, each flange being adapted to engage the locking shoulder of the container. Furthermore, each of the flanges has several vertical weakening lines formed therein which rupture or spread on removal of the closure to divide each flange into segments which flare outwardly by a camming action of the locking shoulder upon removal of the closure cap.

In greater detail, the closure cap of the present invention is suitable for use with any container having an externally threaded neck and locking shoulder. Most common commercial usage of the closure caps dealt with herein relates to the bottling industry — particularly for bottling of pop and alcoholic beverages. However, it will be understood that the closure cap is not limited to use with any particular bottle or the like, but rather is suitable for use with any container having an externally threaded neck and locking shoulder. Furthermore, it will be understood that the term "container neck" refers to that portion of the container surrounding an aperture through which the contents are emptied; the neck may form a portion of the container body per se.

As described above, the closure cap includes a top and an annular peripheral skirt depending from the top. The skirt is usually corrugated — i.e. it has a plurality of ribs and corresponding valleys formed therein. The manufacture of the top and skirt portions is well known in the art as evidenced by the number of crown closure caps in commercial usage.

As is the case in present commercial embodiments of closure caps of the crown type, a liner may be incorporated on the underside of the top portion for seating on a rim of the container neck. The liner employed in the closure cap of the present invention may be any conventional one including, for example, cork, elastomeric materials, etc.

The external threads formed on the container neck are again conventional and preferably comprise a plurality of relatively short thread beads. The purpose of the relatively short thread beads is to enable easy removal of the closure cap by means of a conventional opening device.

The internal surface of the depending skirt has mating threads formed thereon and as is conventional in the art, the pre-formed crown closure is sealed on the container neck and pressure applied such that the skirt material takes the impression of the container thread beads.

The closure cap of the present invention differs from known threaded crown closures in that there is provided at least one flange which depends from the free end margin of the skirt. The flange is preferably formed integrally with the skirt and is adapted to engage the locking shoulder of the container neck. Upon removal of the closure cap from the container neck by an unscrewing of the same, a camming action is applied by the locking shoulder to the flange forcing the same to flare outwardly to indicate that the container has been tampered with even if the closure cap is re-applied to the container.

Preferably, at least two and up to four or more such flanges depend from the skirt. The flanges are also preferably equally spaced apart; between each flange, there is provided sufficient room for a conventional opening device to engage the free marginal edge of the skirt to remove the closure cap in a conventional manner. Thus, when two or more of such flanges are employed, the flanges may have a width of between $\frac{1}{4}$ inch and $\frac{3}{4}$ inch with an intervening free area of between $\frac{1}{2}$ inch and 1 inch.

The flange or flanges are preferably integral with the skirt and formed of the same material. Conventionally, crown closure caps are manufactured of a metallic material such as steel. Other materials including metallic alloys of aluminum and the like may also be employed.

In preferred embodiments of the closure cap of the present invention, there are provided vertical weakening lines within the flange, the weakening lines preferably being formed internally thereof. The vertical weakening lines may be score lines, slits, or coined areas. It is preferred that several such vertical weakening lines are formed in each flange and thus, in a typical embodiment, having flanges with a width of approximately $\frac{3}{4}$ inch, between one and six vertical weakening lines may be formed. As aforementioned, these weakening lines may be score lines, slits, or the like, or alternatively, combinations thereof. The score lines divide the flange into sectors which, upon an unscrewing of the cap, and due to a camming action of the locking shoulder, flare outwardly. The flared sectors do not interfere with effective reclosure of the container if the closure is used to re-seal the same. However, the distorted flared sectors would clearly indicate that the container has been opened.

Still further, the flange or flanges may contain a peripherally extending weakening line therein adjacent its point of joinder with the skirt. This peripheral weakening line may, like the vertical weakening lines, be a continuous score line and/or intermittent slits. The peripheral weakening line provides a bridge between the skirt and flange and does not, in the removal of the cap, fracture but rather permits the outward flaring of the flange or flange segments with a relatively low torque applied to the cap.

In one embodiment of the invention, the peripheral weakening line may comprise a continuous score line wherein material has been removed from the inner surface of the flange at its point of joinder with the skirt. Since crown closure caps are usually formed of a relatively thick material, the removal of the material along the peripheral weakening line permits easier removal of the closure cap.

It will be understood that the peripheral weakening line is not required when the material forming the crown closure cap is relatively thin. Furthermore, the necessity of the peripheral weakening line will depend on the width of the flanges. Still further, if the flanges, during the formation of the closure cap, are made relatively thin, then a plurality of slits may be the most appropriate form of weakening line.

As may be seen from the above description, a torque applied to the closure cap to unscrew the same will cause an outward flaring of the flange and/or flange segments to indicate that the container has been tampered with. In the alternative, the cap can be removed by a conventional opening device; the use of such a device will deform the top of the cap and in addition, the flanges to again indicate that the container has been tampered with.

The closure cap above described may be adapted to many different types of containers. The standard pop and/or alcoholic beverage bottle manufactured for use with threaded crown closures has the thread beads located proximate the rim of the container. Subsequently, the neck tapers inwardly to provide a locking shoulder which is engaged by the flanges of the closure cap. Thus, no modification of presently used bottles is required.

In one embodiment, the flanges extend downwardly solely a sufficient distance such that the ends of the flanges may engage the locking shoulder. However, if so desired, the locking shoulder may be provided by means of a groove in the container neck and the flanges may extend further downwardly — they will be indented in the groove portion and subsequently engage the remainder of the container neck.

Having thus generally described the invention, reference will be made to the accompanying drawings illustrating embodiments thereof, in which:

FIG. 1 is a top plan view of closure caps as cut from a suitable piece of material;

FIG. 2 is a side elevational view of a closure cap according to the present invention;

FIG. 3 is a perspective view of the closure cap of FIG. 2;

Figure 4:
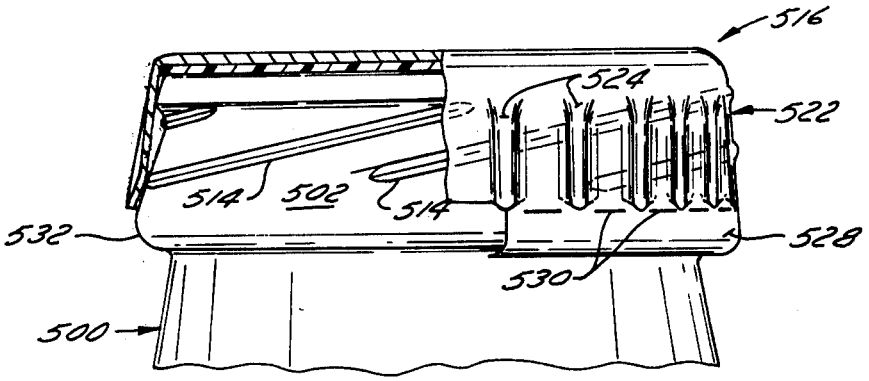
FIG. 4 is a side elevational view, partially in section, of the closure cap as applied on a container.

In greater detail, referring to FIG. 1, there is illustrated closure caps $C_1$, $C_2$, $C_3$, . . . as cut from a suitable piece of material such as an aluminum or steel alloy.

Referring to cap $C_1$, the blank is cut generally in the form of a disc portion 10 having three outwardly extending flanges 12, 14 and 16.

Referring to flange 12, it will be seen that a plurality of spaced-apart slits 18 are formed in flange 12 at its point of joinder with disc portion 10. The closure cap is also provided with a plurality of weakening lines 20 comprising score lines extending from the free marginal edge of flange 12 to the bridges between slits 18 thus dividing flange 12 into a plurality of segments 22. Flanges 14 and 16 are provided with similar weakening lines.

Referring to closure cap $C_2$, a central disc-shaped portion 110 is again provided with three flanges 112, 114 and 116. As seen in FIG. 1, flange 112 again has a peripheral weakening line comprised of slits 118 and score lines 120 extending from the free marginal edge of the flange inwardly. In this embodiment, weakening lines 120 meet with slits 118. A similar arrangement is provided with respect to flanges 114 and 116.

Closure cap $C_3$ has a central disc portion 210 with three flanges 212, 214 and 216 provided about the periphery thereof. In this embodiment, a continuous score line 219 is provided at the point of joinder of flange 212 to disc portion 210 and a plurality of score lines 220 extend from the free marginal edge of flange 212 to score line 219 to divide flange 212 into a plurality of segments 222. A similar arrangement is provided with respect to flanges 214 and 216.

Referring to FIG. 2, a closure cap 300 is illustrated; closure cap 300 has been cut from a suitable piece of material and pre-formed prior to placement on a container. Closure cap 300 generally comprises a top portion 310 with a peripheral annular skirt 312 depending downwardly therefrom. Skirt 312 is "corrugated" having a plurality of ribs 314 with corresponding valleys 316 therebetween. Three flanges 318, 320 and 322 are equally spaced around the periphery of skirt 312 and depend therefrom. The flanges are not corrugated as is skirt 312.

As shown in FIG. 2, flange 318 has an interrupted score line 328 which comprises a plurality of interrupted scores. A vertical weakening line 326 which may comprise a score line extends from each peripheral score line 328. A similar arrangement is provided with respect to flanges 320 and 322.

Referring to FIG. 3, closure cap 400 comprises a top 410 with an annular peripheral skirt 412 depending therefrom; skirt 412 has a plurality of ribs 414 with corresponding valleys 416. Flanges 418, 420 and 422 depend from the marginal edge of skirt 412. As shown in this drawing, flange 422 has a weakening line along its point of joinder with skirt 412; the weakening line comprising a plurality of spaced slits 424.

Referring to FIG. 4, there is illustrated therein a portion of a container 500 which, on the neck portion 502, has a plurality of thread beads 514. A closure cap 516 is illustrated after being placed on neck portion 502 of container 500. Closure cap 516 is similar to that illustrated in FIG. 3; it comprises a crown top 518 having a liner 520 secured thereto. Liner 520 may be of any conventional and suitable material such as cork or an elastomeric material.

Depending from crown top 518 is skirt 522 having a plurality of ribs 524 formed therein. As was the case with the previously described embodiments, a plurality of flanges depend from skirt 522, one such flange being illustrated and designated generally by reference numeral 528. Flange 528 has a plurality of spaced slits or scores 530 formed therein, the scores extending in a peripheral line adjacent the line of joinder of the flange 528 to skirt 522.

Cap 516 is initially die-cut from a suitable piece of material such as illustrated in FIG. 1. At the time of die-cutting, slits or scores 530 may also be cut and the cap preformed to a configuration such as those shown in FIGS. 2 and 3. Subsequently, the cap is placed on neck 502 of container 500 and clamped thereon in a conventional manner. In so doing, the internal surface of skirt 522 takes the form of thread beads 514 so that the cap may be screw-threadedly engaged with said thread beads 514. Subsequently, flange 528 is deformed inwardly to engage a locking shoulder 532 as shown in FIG. 4.

Thus, closure cap 516 may be removed from container 500 by unscrewing of the same. In so doing, locking shoulder 532 applies a camming action on flange 528 which will then flare outwardly, bending along score or slit lines 530 to indicate that the container has been tampered with.

Figure 5:
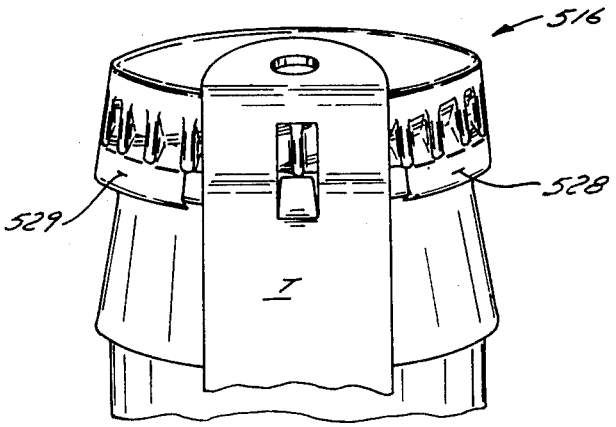
FIG. 5 is a perspective view of a closure cap on a container.

In the alternative, as shown in FIG. 5, a conventional opening device T may be employed between a pair of flanges 528 and 529 to open the container in a conventional manner. In so doing, flanges 528 and 529 will again flare outwardly to indicate that the container has been tampered with.

In preferred embodiments, as discussed with respect to closures $C_1$, $C_2$ and $C_3$, upon removal of the cap, the flanges will split along the vertical weakening lines when the locking shoulder applies a camming action on the flange thus dividing the flanges into a plurality of segments which flare outwardly bending along the peripheral weakening line.

It will be understood from the above description that many different combinations of weakening lines may be used. Thus, for example, the peripheral weakening line may be a continuous score line wherein the flange is cut to a desired depth on the inner surface thereof. A similar score line may be employed for the vertical weakening lines. In the alternative, slits or perforations may be employed; these are well known in the art and need not be described herein. As previously mentioned, those skilled in the art can well ascertain the number of score lines and their spacing depending on the material from which the closure cap is made and the thickness thereof. The thinner the material, the less which is required by way of weakening lines.

I claim:

1. A closure cap for use with a container having an externally threaded neck and a locking shoulder, said closure cap comprising a top, a peripheral skirt depending from the top, said skirt being corrugated and having threads formed thereon for mating engagement with the threaded neck of the container, and a plurality of flanges integral with and depending from said skirt, each flange being spaced from an adjacent flange by a distance sufficient to permit use of an opening device on a free marginal edge of said skirt between adjacent flanges, each of said flanges being adapted to engage the locking shoulder of said container, each of said flanges having at least one vertical line of weakening formed therein which rupture or spread on removal of said closure by an unscrewing motion to divide each flange into segments which flare outwardly by a camming action of the locking shoulder upon removal of the closure cap.

2. The closure cap of claim 2 comprising three equally spaced-apart flanges depending from said skirt.

3. The container of claim 2 wherein each flange has a peripheral line of weakening of interrupted slits adjacent the point of joinder of said flange to said skirt.

4. The closure cap of claim 3 wherein each of said flanges has several vertical lines of weakening formed therein, each line of weakening terminating at a free marginal edge of the flange.

5. The closure cap of claim 4 wherein said vertical lines of weakening are selected from score lines, interrupted slits, or a continuous slit.

6. The closure cap of claim 5 wherein each flange has a continuous peripheral weakening line adjacent the point of joinder of said flange to said skirt, said continuous peripheral weakening line comprising a score line.

7. The closure cap of claim 2 wherein each flange has a continuous peripheral weakening line adjacent the point of joinder of said flange to said skirt.

8. The closure cap of claim 4 wherein said peripheral line of weakening comprises a score line with material removed from an interior surface of the flange.

9. The closure cap of claim 5 including a liner on the underside of said top.

10. The closure cap of claim 2 wherein said flanges have a thickness less than the thickness of said skirt.

* * * * *